US006666710B2

(12) United States Patent
Saka et al.

(10) Patent No.: US 6,666,710 B2
(45) Date of Patent: Dec. 23, 2003

(54) CONNECTOR AND A CONNECTOR ASSEMBLY

(75) Inventors: Yukinori Saka, Yokkaichi (JP); Atsushi Yamaoka, Yokkaichi (JP); Koji Okutani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/411,525

(22) Filed: Apr. 10, 2003

(65) Prior Publication Data

US 2003/0194905 A1 Oct. 16, 2003

(30) Foreign Application Priority Data

Apr. 12, 2002 (JP) ..... 2002-110806

(51) Int. Cl.[7] ..... H01R 3/00
(52) U.S. Cl. ..... 439/489
(58) Field of Search ..... 439/488, 489, 439/188, 752, 352, 357, 358

(56) References Cited

U.S. PATENT DOCUMENTS 6,036,515 A * 3/2000 Nakamura ..... 439/489
6,241,542 B1 6/2001 Nishide et al. ..... 439/188
6,315,585 B1 * 11/2001 Oka ..... 439/489
6,361,337 B2 * 3/2002 Kurimoto ..... 439/157
6,419,507 B2 * 7/2002 Kurimoto ..... 439/157

* cited by examiner

*Primary Examiner*—Tho D. Ta
(74) *Attorney, Agent, or Firm*—Gerald E. Hespos; Anthony J. Casella

(57) ABSTRACT

A connector assembly has a male housing (10) with a receptacle (11) and a female housing (20) that can be received in the receptacle (11). The female housing (20) has a resiliently deformable lock arm (28) with a projection (30) for engaging a lock (13) on the male housing (10) when the housings (10, 20) are connected properly. A slider (70) is movable on the female housing (20) between a position that permits deformation of the lock arm (28) and a position that prevents deformation of the lock arm (28). Coil springs (80) bias the slider (70) to the deformation preventing position to lock the properly connected housings (10, 20) together. The housings (10, 20) can be separated by deforming the lock arm (28) and pulling both the slider (70) and the female housing (20) back from the male housing (10).

20 Claims, 14 Drawing Sheets

CONNECTOR AND A CONNECTOR ASSEMBLY

BACKGROUND OF THE INVENTION

1. Field of the Invention

The invention relates to a connector and to a connector assembly with a partial connection preventing function.

2. Description of the Related Art

A connector for an airbag circuit of an automotive vehicle or for other critical circuits may be constructed to prevent the connector from being left partly connected during a connecting operation. U.S. Pat. No. 6,241,542 and FIGS. 14 and 15 herein show such a connector. With reference to FIGS. 14 and 15, the connector has a male housing 1 and a female housing 2. A lock arm 3 is formed on the male housing 1 and is deformed resiliently while moving onto a lock 4 on the female housing 2 as the housings 1, 2 are connected. A slider 5 is assembled with the male housing 1 and is held by the deformed lock arm 3 so as not to move backward. A spring 6 in the slider 5 is compressed by a rib 7 of the female housing 2 and accumulates a biasing force for separating the housings 1, 2. The biasing force of the spring 6 is released if the connecting operation is interrupted with the housings 1, 2 only partly connected, and the housings 1, 2 are separated forcibly.

The lock arm 3 returns to engage the lock 4 when the connectors 1, 2 are connected properly. Additionally, the lock arm 3 disengages from the slider 5 during the return of the lock arm 3. Thus, the biasing force of the spring 6 is released to move the slider 5 back. At this time, a restricting portion 8 of the slider 5 enters a deformation space above the lock arm 3 and prevents the lock arm 3 from being deformed. In this way, the housings 1, 2 are held in their connected condition, and connection reliability of the airbag circuit can be improved.

The two housings 1, 2 may have to be separated for maintenance or for some other reason. Thus, the slider 5 is moved forward to retract the restricting portion 8 forward from the lock arm 3. The lock arm 3 then is deformed and disengaged from the lock 4 and the male housing 1 is pulled back.

The separation of the two housings 1, 2 requires the slider 5 to be moved forward and then requires the male housing 1 to be moved back. However, operability has not been good because the male housing 1 and the slider 5 must be operated in completely opposite directions.

The present invention was developed in view of the above problem and an object thereof is to improve separation operability.

SUMMARY OF THE INVENTION

The invention relates to a connector with a housing that is connectable with a mating housing of a mating connector. The housing has a lock arm that moves onto a lock on the mating housing and deforms resiliently in the process of connecting the two housings. The lock arm returns to engage the lock when the housings are connected properly. A slider is movable forward and backward substantially along a connecting direction of the housings between a deformation preventing position where the slider prevents deformation of the lock arm and a deformation permitting position where the slider permits deformation of the lock arm. The slider engages the resiliently deformed lock arm in the process of connecting the housings and is prevented from moving forward from the deformation permitting position. A pivotal member is pivotal about an axis arranged at an angle, and preferably a right angle, to the connecting direction. The pivotal member has a first end directly or indirectly pushed by a pushing portion of the mating housing in the process of connecting the two housings. At least one biasing member is provided between the slider and the second end of the pivotal member provided behind the slider. The biasing member is deformed resiliently and accumulates a biasing force to separate the housings as the slider and the second end of the pivotal member are displaced toward each other.

The lock arm is deformed resiliently and moves onto the lock when the two housings are connected. The deformed lock arm engages the slider to prevent the slider from moving forward from the deformation permitting position toward the deformation preventing position. The first end of the pivotal member is pushed by the pushing portion of the housing in this state. Thus, the pivotal member is pivoted about its supported portion, and the first end of the pivotal member is displaced back and the second end thereof is displaced forward. At this time, the biasing member is pushed forward by the second end of the pivotal member and is compressed resiliently between the slider and the pivotal member.

If the connecting operation is interrupted halfway, the biasing force accumulated in the biasing member is released to separate the two housings forcibly. This prevents the two housings from being left partly connected.

The lock arm returns to engage the lock when the housings are connected properly and the slider is freed from its locked state by the lock arm. Thus, the biasing force accumulated in the biasing member thus far is released to move the slider forward to the deformation preventing position. At this stage, the slider prevents the resilient deformation of the lock arm. Accordingly, the two housings are held firmly and properly connected with each other.

The two properly connected housings can be separated by first moving the slider back from the deformation preventing position to the deformation permitting position. The housing then can be pulled back from the mating housing and the lock arm is deformed resiliently to disengage from the lock.

The biasing member is pushed forward and is deformed by the pivotal member in the connecting process. Thus, the slider can be moved forward by the biasing force of the biasing member released when the two housings are connected properly. Separation operability is good since the slider is operated in the same direction as the connector housing is separated.

The slider, in the deformation preventing position, preferably is in a deformation space for the lock arm to prevent deformation of the lock arm and the slider, in the deformation permitting position, is retracted from the deformation space to permit the resilient deformation of the lock arm.

The lock arm and the lock may have a semi-locking construction. More particularly, at least one of the lock arm and the lock may have an unlocking guide surface for guiding disengagement of the lock arm from the lock by resiliently deforming the lock arm when a force of a specified intensity or higher acts to move the housing back. Thus, the lock arm is deformed when the slider is moved back from the deformation preventing position to the deformation permitting position during separation of the housings, and is guided through a disengagement from the lock by the unlocking guide surface. Accordingly, the lock arm is freed automatically from the locked state and separation operability is good.

The housing preferably comprises a support for supporting the pivotal member in a posture held substantially in contact with the biasing member before the two housings are connected.

The biasing member can be pushed and resiliently deformed by the second end of the pivotal member when the two housings are connected.

The slider comprises a holding arm for preventing the slider from moving forward from the deformation permitting position. The holding arm is engaged resiliently with at least one holding portion on the housing. At least one of the holding arm and the holding portion has a disengagement guiding surface for guiding the disengagement of the holding arm from the holding portion by resiliently deforming the holding arm when a force of a specified intensity or higher acts to move the slider forward.

The slider can be held at the deformation permitting position until the connectors are connected. Thus, the connecting operation can be performed with the slider at the deformation permitting position and operability is good. The holding arm and the holding portion have a semi-locking construction. Thus, the holding arm is deformed when the biasing force of the biasing member acts to move the slider forward during the connecting operation and is guided to be disengaged from the holding portion by the disengagement guiding surface. As a result, the slider is permitted to move forward to the deformation preventing position and separation operability is good.

A movable member may be movable on the housing, and the pivotal member may be pushed by the pushing portion of the mating housing via the movable member.

The pivotal member preferably is at an initial position before the connector housings are connected, and a spring contact portion of the pivotal member is held in contact with the biasing member. At least one portion of the pivotal member preferably is held in contact with at least one support of the housing. Thus, the pivotal member is supported at the inclined initial position.

A pushable portion of the pivotal member preferably is held in contact with the moving member when the pivotal member is at the initial position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
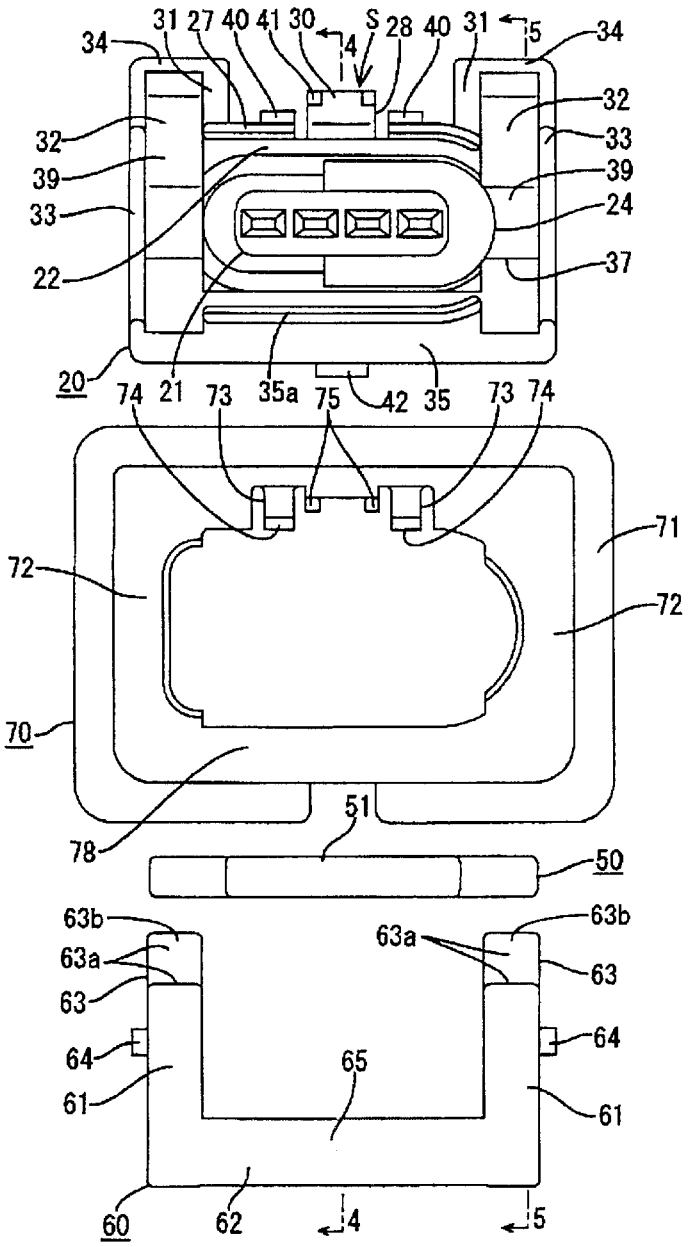
FIG. 1 is a front view of a female housing, a slider, a pivotal member and a spacer according to one embodiment of the invention.

A connector according to the invention is illustrated in FIGS. 1 to 13, and is intended for use in an airbag circuit of an automotive vehicle. The connector includes a male housing 10 connected with a piece of equipment and a female housing 20 provided at ends of unillustrated wires. The male and female housings 10, 20 are connectable with each other. In the following description, engaging sides of the two housings 10, 20 are referred to as the front and reference is made to FIGS. 1 and 9 concerning vertical direction.

The male housing 10 is made e.g. of a synthetic resin and, as shown in FIG. 9, has a forwardly projecting substantially tubular receptacle 11. Four substantially tab-shaped male terminals 12 project from the back wall of the male housing 10 and are surrounded by the receptacle 11. A lock 13 projects up substantially at the widthwise center of the upper surface of the receptacle 11. The front end surface of the lock 13 is sloped upward to the back so that the lock arm 28 can easily move onto the lock 13.

Figure 4:
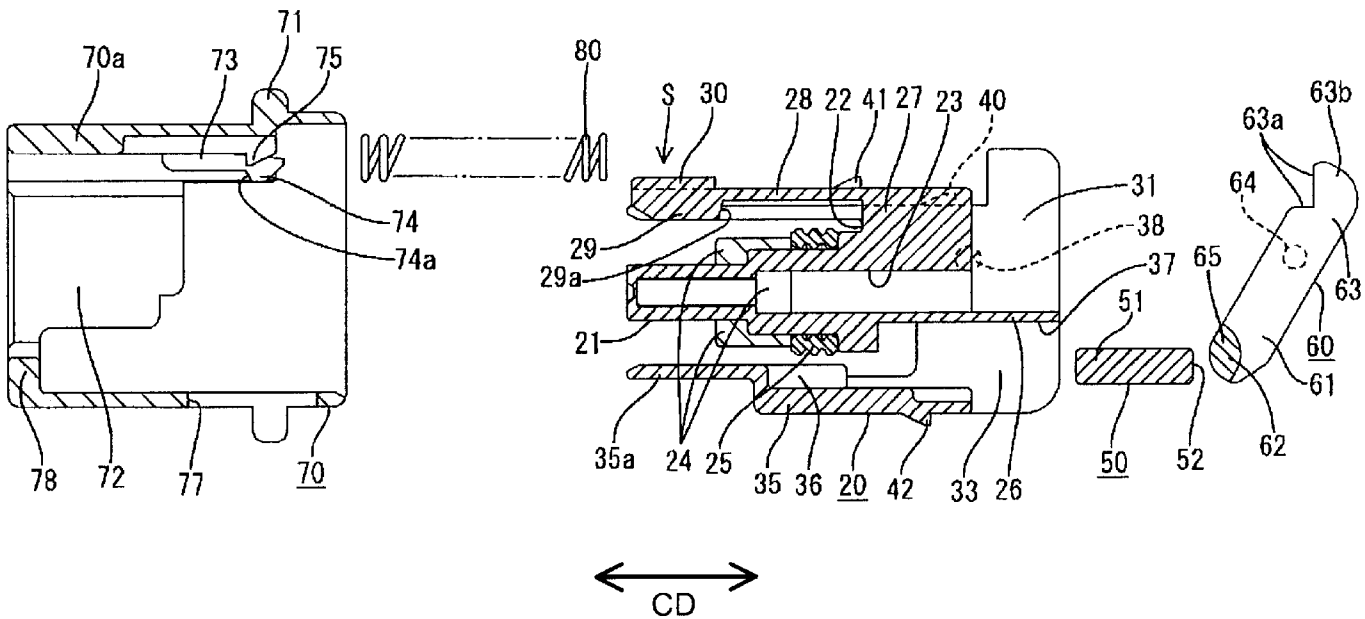
FIG. 4 is a section along 4—4 of FIG. 1.

The female housing 20 is made e.g. of a synthetic resin and, as shown in FIGS. 1 and 4, has a terminal accommodating portion 21 for accommodating female terminal fittings (not shown) that are connected with the wires. A fitting groove 22 is formed around the terminal accommodating portion 21 and the receptacle 11 of the male housing 10 fits into the fittable grooves 22 from the front.

Figure 3:
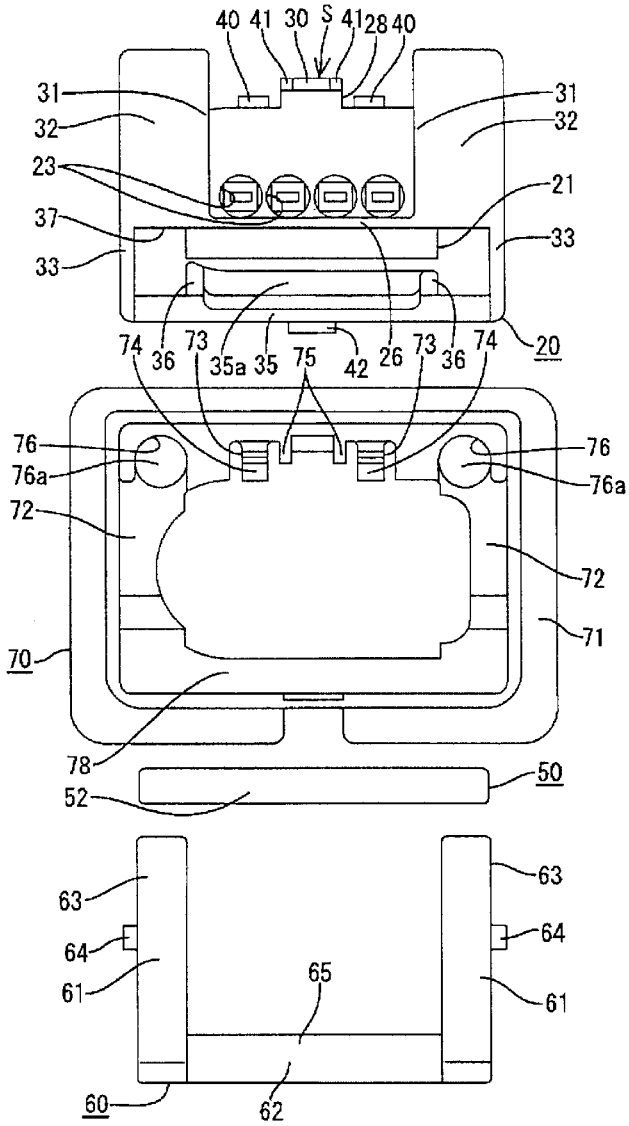
FIG. 3 is a rear view of the female housing, the slider, the pivotal member and the spacer.

Four cavities 23 are formed substantially side by side in the terminal accommodating portion 21, as shown in FIGS. 3 and 4, and are dimensioned to receive the female terminal fittings. A longitudinal middle part of the terminal accommodating portion 21 and an area behind this middle part are widened laterally to form steps. A retainer 24 is mounted sideways on the front stepped portion and enters the cavities 23 to lock the female terminal fittings in the cavities 23. The receptacle 11 is fittable into the fitting groove 22 and onto the outer peripheral surface of the rear stepped portion. A seal ring 25 is fit on the outer peripheral surface of the terminal accommodating portion 21 immediately before the rear stepped portion and is squeezed between the outer peripheral surface of the terminal accommodating portion 21 and the inner peripheral surface of the receptacle 11 for providing a watertight fit between the two housings 10, 20. The retainer 24 is before the seal ring, and hence prevents the seal ring 25 from coming out. A guiding wall 26 projects back from the rear bottom end of the terminal accommodating portion 21 and is coupled to inner walls 31 for guiding the insertion of the female terminal fittings into the respective cavities 23.

Figure 2:
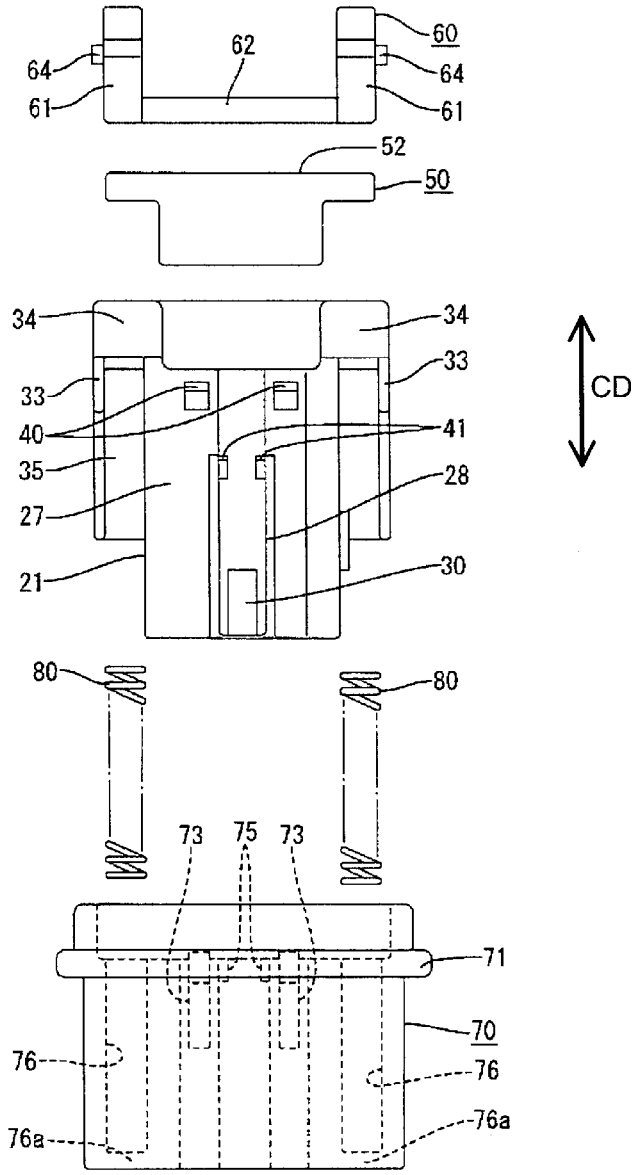
FIG. 2 is a plan view of the female housing, the slider, the pivotal member and the spacer.

The upper wall 27 has substantially the same length as the terminal accommodating portion 21 and is coupled to the upper surface of the rear portion of the terminal accommodating portion 21. The fitting groove 22 separates the front half of the upper wall 27 from the terminal accommodating portion 21, as shown in FIGS. 2 and 4. A widthwise middle of the upper wall 27 is raised to form a step, and a cantilevered lock arm 28 is formed by two slits of a specified depth at positions on the opposite side of the raised part. A hook 29 projects from the lower surface of a front end of the lock arm 28 and is engageable with the lock 13. The lock arm 28 is resiliently deformable about the back ends of the slits and retracts into a deformation space S located above. An upwardly and backwardly sloped unlocking guide surface 29*a* is formed at the rear end of the hook 29 and is engageable with the lock 13. Thus, the lock arm 28 and the lock 13 have a semi-locking construction. A locking projection 30 projects from the upper surface of the front end of the lock arm 28 at the opposite side of the hook 29, and the rear end surface of the locking projection 30 is engageable with the front end surface of the slider 70 during the resilient deformation of the lock arm 28.

Figure 5:
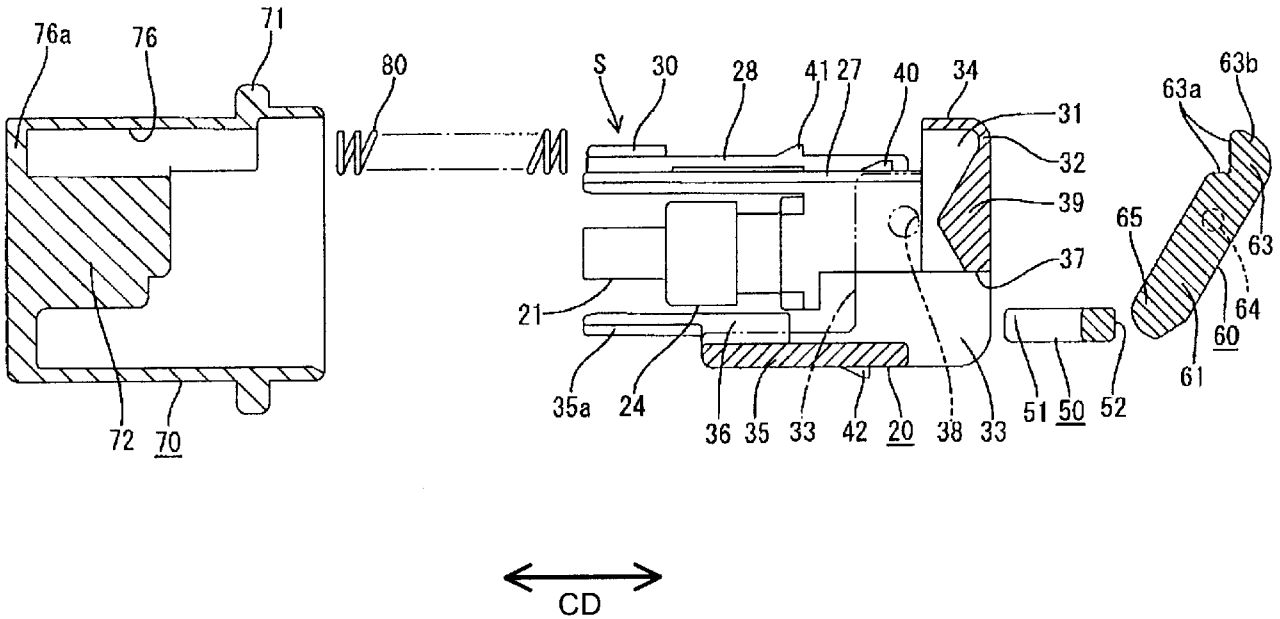
FIG. 5 is a section along 5—5 of FIG. 1.

Two inner walls 31 project back and up at the opposite sides of the rear end surfaces of the terminal accommodating portion 21 and the upper wall 27, and a rear wall 32 projects out sideways from the rear end of each inner wall 31, as shown in FIGS. 1, 2 and 5. An outer wall 33 is provided at the outer side end of each rear wall 32 and projects more forward than the inner walls 31 and more down than the inner walls 31 and the rear walls 32. The outer walls 33 are stepped and only upper parts of the outer walls 33 have their front ends aligned with the inner walls 31. The upper ends of the outer walls 33 are coupled to the inner walls 31 and the rear walls 32 by a ceiling wall 34. The bottom wall 35 bridges the front bottom ends of the outer walls 33 and has opposite lateral ends standing along the outer walls 33.

The bottom wall 35 extends from the rear end of the terminal accommodating portion 21 substantially to the front stepped portion of the terminal accommodating portion 21. An extending portion 35*a* extends forward and up from a part of the bottom wall 35 corresponding to the terminal accommodating portion 21 with respect to widthwise direction. The front end of the extending portion 35*a* has a front end substantially aligned with the front end of the terminal accommodating portion 21. The fitting groove 22 for receiving the receptacle 11 is immediately inside the extending portion 35*a*. Two narrow ribs 36 project back from the opposite sides of the rear surface of the extending portion 35*a* as shown in FIGS. 3 and 5. A rear end of the bottom wall 35 is partially thinned.

Figure 6:
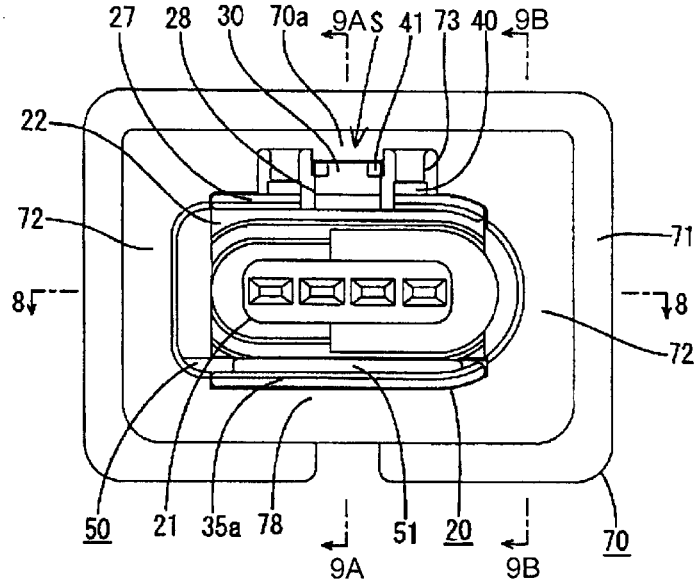
FIG. 6 is a front view showing a state where the slider and the like are mounted into the female housing.
Figure 7:
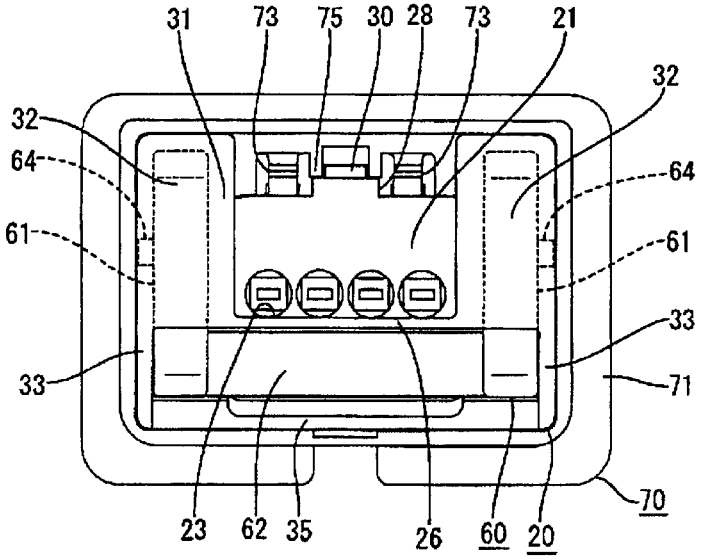
FIG. 7 is a front view showing the state where the slider and the like are mounted into the female housing.

A substantially rectangular opening 37 is formed at a lower part of the rear surface of the female housing 20 and is substantially surrounded by the guiding wall 26, the inner walls 31, the rear walls 32, the outer walls 33 and the bottom wall 35, as shown in FIG. 3. A spacer 50 is mountable into the female housing 20 from behind through the opening 37. The spacer 50 is a substantially flat plate and is made e.g. of a synthetic resin and is slightly wider than a space between the two outer walls 33. Opposite sides of the spacer 50 are cut off from the front for a length substantially equal to the length of the ribs 36 as shown in FIGS. 2 and 4. The spacer 50 is mounted between the bottom wall 35 and the rear stepped portion of the terminal accommodating portion 21 in the female housing 20. An entering portion 51 is formed at the upper half of the spacer 50 and projects in from the extending portion 35*a* and enters the fitting groove 22, as shown in FIGS. 6 and 9. The entering portion 51 is pushable by a front end 10*a* of the receptacle 11 of the male housing 10 during connection of the housings 10, 20. The spacer 50 is movable forward and back substantially along a connecting direction CD of the two housings 10, 20 between an initial position (see FIG. 9) and a pushed position (see FIG. 12). The front middle of the spacer 50 contacts the rear surface of the extending portion 35*a* of the bottom wall 35 and the front surfaces of its opposite sides contact the rear of the ribs 36 when the spacer is in the initial position as shown in FIG. 4. The pushed position (see FIG. 12) is reached by moving the spacer 50 back from the initial position.

The connector also includes a substantially U-shaped pivotal member 60 made e.g. of a synthetic resin. The pivotal member 60 has substantially the same width as the spacer 50 and includes a pair of vertically-extending arms 61 and a coupling 62 that couples the inner surfaces of the bottom ends of the arms 61, as shown in FIGS. 1, 4 and 5. Upper and lower ends of each arm 61 are rounded, and a front part of the upper end of each arm 61 is cut off to form a spring contact 63 with a pair of substantially straight surfaces 63*a* aligned substantially normal to each other. A leading end 63*a* of each spring contact 63 defines a pointed claw. The bottom end of each arm 61 is cut off to have a substantially straight rear surface, and the coupling 62 is coupled to a portion before the straight rear surface. The front surfaces of the arms 61 and the coupling 62 are rounded, and the rear surface of the coupling 61 also is rounded.

Figure 8:
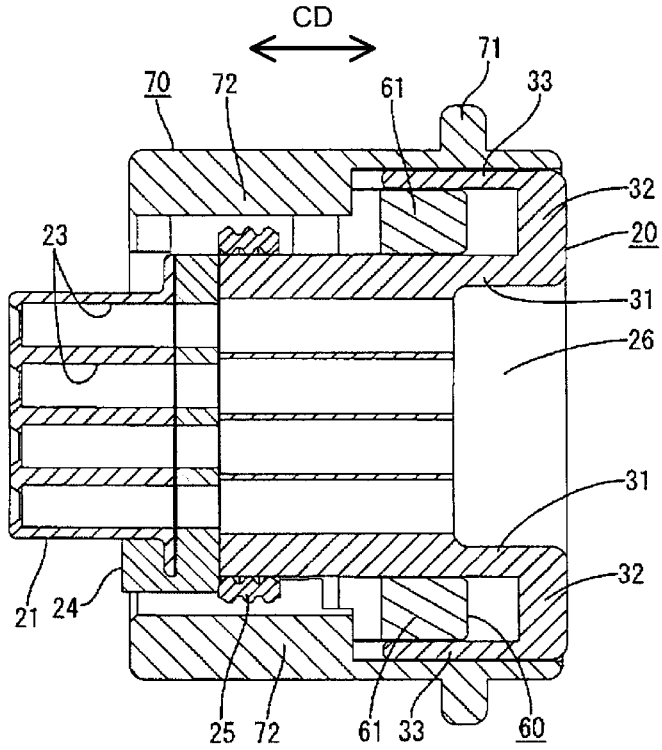
FIG. 8 is a section along 8—8 of FIG. 6.

A cylindrical shaft 64 projects sideways from the outer side surface of each arm 61 slightly above the longitudinal middle of the arm 61 and below the spring contact 63. The coupling 62 is behind the rear stepped portion and the fitting groove 22 of the terminal accommodating portion 21 when the pivotal member 60 is mounted into the female housing 20. The two arms 61 are surrounded by the inner walls 31, the rear walls 32, the outer walls 33, the ceiling wall 34 and/or the bottom wall 35, and the two shafts 64 are fit into substantially round shaft holes 38 formed in both outer walls 33 as shown in FIGS. 8 and 9. The pivotal member 60 is supported to pivot about the shafts 64 forward and backward substantially along the connecting direction CD between an initial position (see FIG. 9) where the arms 61 are inclined backward and a pushed position (see FIG. 12) where the arms 61 are inclined forward. Thus, the pivotal member 60 is pivotable about the shaft 64 and the shaft holes 38 defining a pivotal axis aligned substantially normal to the connecting direction CD. The bottom ends of the arms 61 and the coupling 62 define a pushable portion 65 that normally is held in contact with a rear end surface 52 of the spacer 50 in the mounted state of the pivotal member 60. The pushable portion 65 can be pushed back by the spacer 50 as the spacer 50 is pushed back by the front end surface 10*a* of the receptacle 11 fit into the fittable groove 22.

The pushable portion 65 is held in contact with the rear end surface 52 of the spacer 50 when both the spacer 50 and the pivotal member 60 are at the initial position. Additionally, both straight surfaces 63*a* of each spring contact 63 are held in contact with the rear end surface and the bottom surface of a corresponding compression coil spring 80 as shown in FIG. 9(B). At this stage, the rear surfaces of the arms 61 above the shafts 64 are held in contact with supports 39 projecting from the rear walls 32, and the pivotal member 60 is supported at the initial position where it is inclined backward. Each support 39 has a substantially triangular cross section and the front vertex is substantially at the same position as the shaft hole 38 with respect to the height direction. The pushable portion 65 is held in contact with the rear end surface 52 of the spacer 50 when both the spacer 50 and the pivotal member 60 are at the pushed position, whereas leading ends 63*b* of the spring contacts 63 are held substantially in contact with the rear end surfaces of the compression coil springs 80. Further, a part of the pivotal member 60 below the shafts 64 is caused to escape into a space below the supports 39. The pivotal member 60 is pivotal about the shaft 63 and the shaft hole 38. Thus, the pivotal member 60 can convert a backward movement of the pushable portion 65 into a forward movement of the spring contact 63 to compress the compression coils springs 80. Conversely, a resilient expansion of the compression coil springs 80 pushes the spring contact 63 back. This backward movement is converted in a forward movement of the pushable portion 65 directly interacting with the male housing 10.

A rectangular frame-shaped slider 70 is shown in FIGS. 1 and 2 and is assembled to surround the female housing 20. An operable portion 71 bulges out over the entire periphery of the slider 70 slightly before the rear end. The operable portion 71 can be pushed or pulled during the connecting or separating operations (see FIG. 9 or 12). Bulges 72 project in from the inner surfaces of the opposite sides of the slider 70 for surrounding the opposite sides of the fitting groove 22 of the female housing 20 in the assembled state of the slider 70, as shown in FIG. 6. The bulges 72 are provided over a length from the front end of the slider 70 to a position slightly before the outer walls 33, as shown in FIG. 8.

The upper part of the slider 70 is thinned to form steps at portions corresponding to the lock arm 28 of the female housing 20 and the opposite sides of the lock arm 28, and two holding arms 73 project from the bottom surfaces of the thinned opposite sides as shown in FIG. 1. Each holding arm 73 is cantilevered back, as shown in FIG. 4, and is resiliently deformable upwardly. A hook 74 projects from the lower surface of the projecting end of each holding arm 73. Two stoppers 75 project at the bottom surface of the rear part of the thinned portion corresponding to the lock arm 28. A portion of the upper part of the slider 70 behind the operable portion 71 is raised slightly and thinned, and the ceiling wall 34 of the female housing 20 can be brought into contact with an inner stepped portion there.

Figure 9A:
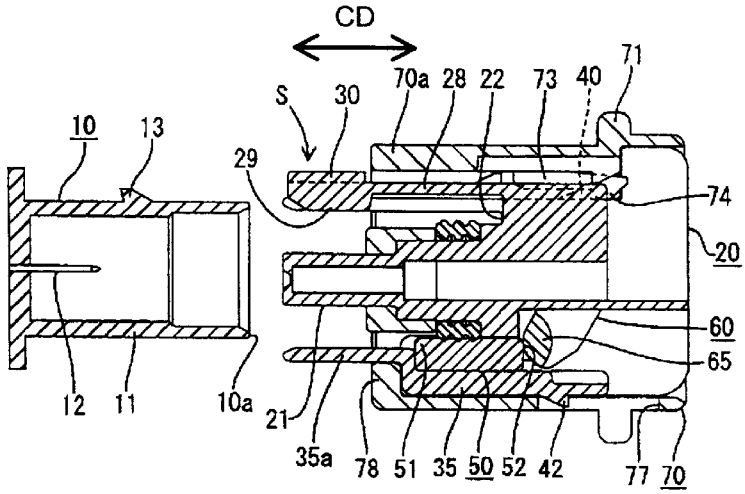
FIGS. 9(A) and 9(B) are sections along 9A—9A and 9B—9B of FIG. 6 showing a state before the two housings are connected, respectively.
Figure 9B:
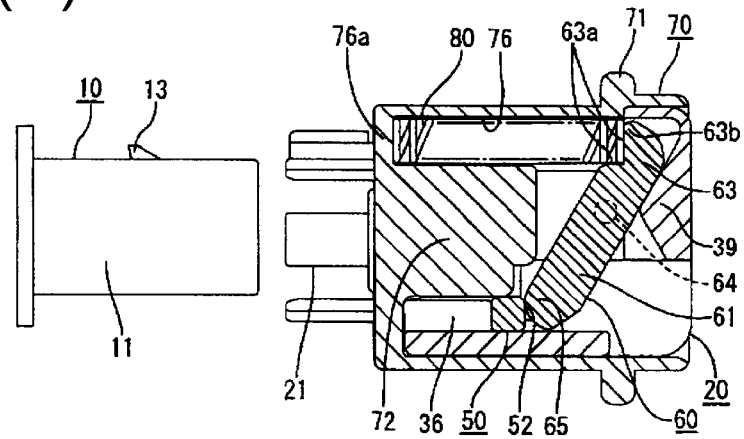

The slider 70 is assembled on the female housing 20 so that the hooks 74 of the holding arms 73 engage holding projections 40 at positions on the upper wall 27 at opposite sides of the lock arm 28, as shown in FIG. 9(A). At this stage, the slider 70 is in a deformation permitting position with the upper portion of the slider 70 retracted back from the deformation space S for the lock arm 28. Thus, the lock arm 28 can deform. On the other hand, the slider 70 can be moved forward to a deformation preventing position where a deformation preventing portion 70*a* on the upper part of the slider 70 is in the deformation space S (see FIG. 12(A)). Thus, the lock arm 28 cannot deform. At this time, the stoppers 75 contact first front-stop projections 41 on the upper surface of the lock arm 28. Disengagement guiding surfaces 74*a* that slope up and to the front are formed on the front surfaces of the hooks 74. The disengagement guiding surfaces 74*a* engage the holding projections 40 with a semi-locking construction.

Two spring accommodating recesses 76 are formed on opposite upper corners of the slider 70 and open backward, as shown in FIGS. 3 and 5 for accommodating a pair of compression coil springs 80. The back walls of the spring accommodating recesses 76 define receiving portions 76*a* for receiving the front ends of the compression coil springs 80. The compression coil springs 80 can be held by the surrounding walls of the spring accommodating recesses 76 so as not to shake in a direction inclined to the connecting direction CD. A bottom part of the surrounding wall of each spring accommodating recess 76 is cut over a specified depth so as not to interfere with the pivotal member 60 (see FIG. 9).

An escaping hole 77 penetrates a rear portion of the bottom part of the slider 70 at a widthwise middle position. The escaping hole 77 permits the escape of a second front-stop projection 42 on the bottom surface of the bottom wall 35 of the female housing 20 as the slider 70 is assembled as shown in FIG. 9(A). The second front-stop projection 42 abuts against the rear edge of the escaping hole 77 when the slider 70 reaches the deformation preventing position (see FIG. 12(A)). A rear-stop wall 78 projects up from the front end of the bottom part of the slider 70, and contacts the front surface of the bottom wall portion 35 (excluding the extending portion 35*a*) of the female housing 20.

The female connector is assembled from the state shown in FIGS. 4 and 5 by inserting the spacer 50 from behind through the opening 37 and to the initial position in the female housing 20. The pivotal member 60 then is inserted from behind through the opening 37 and into the female housing 20. The pivotal member 60 is disposed in the initial position and is inclined back with the shafts 64 fit into the corresponding shaft holes 38. At this time, the pivotal member 60 is supported at the initial position by the contact of the pushable portion 65 with the rear end surface 52 of the spacer 50 and the contact of the rear surfaces of the upper parts of the arms 61 with the corresponding supports 39.

The compression coil springs 80 are accommodated in the spring accommodating recesses 76 of the slider 70. The slider 70 then is assembled with the female housing 20 from the front into the deformation permitting position. In this process, the holding arms 73 are at the opposite sides of the lock arm 28 and deform resiliently up as the hooks 74 move onto the holding projections 40. The hooks 74 move over the holding projections 40 when the slider 70 reaches the deformation permitting position. Thus, the holding arms 73 return and the disengagement guiding surfaces 74*a* of the hooks 74 engage the rear surfaces of the holding projections 40. In this way, the slider 70 cannot move forward along the connecting direction CD from the deformation permitting. At this time, each compression coil spring 80 has its rear end held in contact with both substantially straight surfaces 63*a* of the corresponding spring contact 63 and is held slightly resiliently compressed between the receiving portion 76*a* and the spring contact 63 as shown in FIG. 9(B). The female terminal fittings, the retainer 24, the seal ring 25, etc. are mounted into the female housing 20.

Figure 10A:
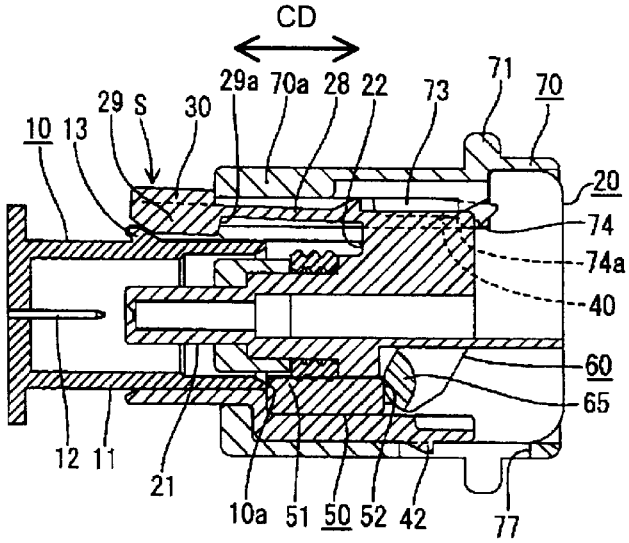
FIG. 10(A) is a section similar to FIG. 9(A) showing a state where a front end surface of a receptacle comes into contact with the spacer during a connecting operation of the two housings.
Figure 10B:
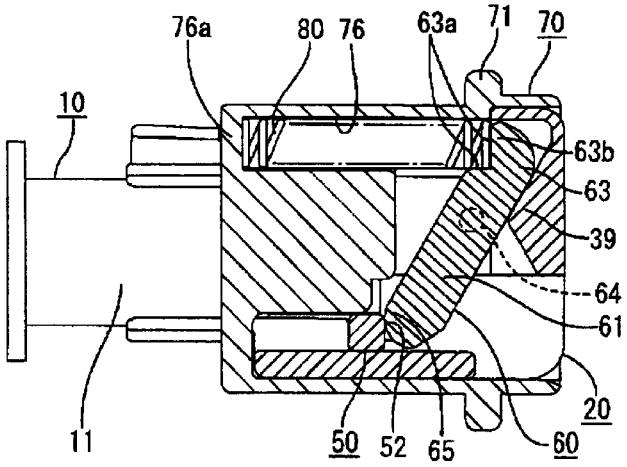
FIG. 10(B) is a section similar to FIG. 9(B) showing a state before the pivotal member is pivoted from an initial position during the connecting operation of the two housings.

The male and female housings are connected by pushing the operable portion 71 of the slider 70 forward while the receptacle 11 of the male housing 10 and the fitting groove 22 of the female housing 20 are opposed to each other. The connecting operation may be performed by pushing the rear end of the female housing 20. The hook 29 of the lock arm 28 moves onto the lock 13 as the receptacle 11 enters the fitting groove 22 and resiliently deforms the lock arm 28. At this stage, the front end of the lock arm 28 and the locking projection 30 move up into the deformation space S and the rear end surface of the locking projection 30 engages the front end surface of the upper part of the slider 70 to prevent the slider 70 from moving forward from the deformation permitting position, as shown in FIG. 10. The front end surface 10*a* of the receptacle 11 then contacts the entering portion 51 of the spacer 50. The spacer 50 is pushed back by the front end surface 10*a* of the receptacle 11 as the connecting operation proceeds, and the pushable portion 65 of the pivotal member 60 is pushed back by the rear end surface 52 of the spacer 50 as the spacer 50 is moved back. The pivotal member 60 then pivots about the shafts 64. Thus, the spring contacts 63 at the upper end are displaced forward and the rear ends of the compression coil springs 80 are pushed forward by the claw-shaped leading ends 63*b*. The front ends of the compression coil springs 80 are received by the receiving portions 76*a* of the slider 70 and are prevented from moving forward. Thus, the compression coil springs 80 are compressed resiliently between the receiving portions 76*a* and the spring contacts 63 moving forward with respect to the receiving portions 76*a* and biasing forces to separate the two housings 10, 20 accumulate gradually in the compression coil springs 80 (see FIG. 11(B)).

The connecting operation could be interrupted halfway. In this situation, the biasing forces accumulated in the compressed coil springs 80 are released and the pushable portion 65 of the pivotal member 60 pushes the front end surface 10*a* of the receptacle 11 back via the spacer 50 to separate the housings 10, 20. This prevents the two housings 10, 20 from being left partly connected.

Figure 11A:
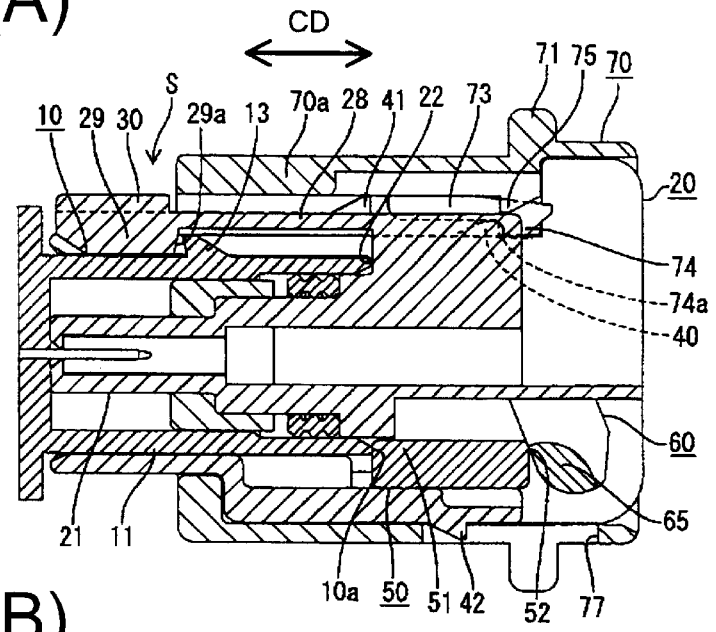
FIG. 11(A) is a section similar to FIG. 9(A) showing a state where the two housings are properly connected and a locking projection is disengaged from the slider.
Figure 11B:
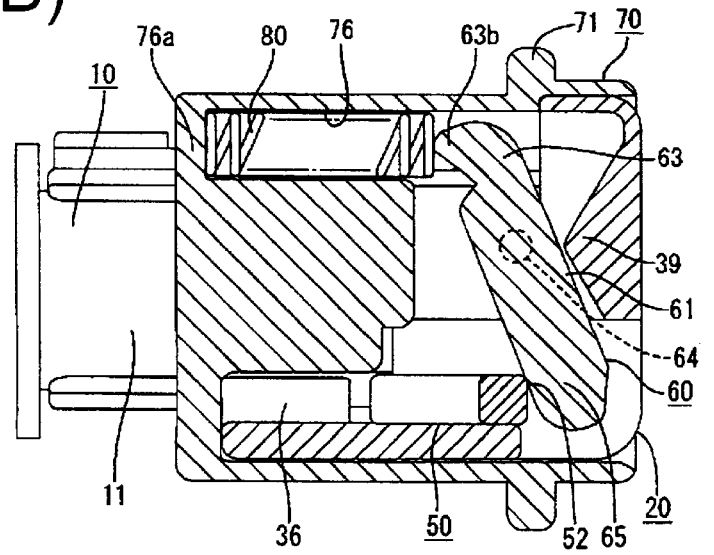
FIG. 11(B) is a section similar to FIG. 9(B) showing a state where the two housings are properly connected and compression coil springs are resiliently compressed by the pivotal member displaced to a pushed position.

When the two housings 10, 20 are connected to proper depth, the hook 29 of the lock arm 28 moves over the lock 13 and resiliently returns. Thus, the unlocking guide surface 29*a* of the hook 29 is engaged with the rear end surface of the lock 13, as shown in FIG. 11. The locking projection 30 is disengaged from the front end surface of the slider 70 as the lock arm 28 returns, thereby freeing the slider 70 to move along the connecting direction CD. At this time, the pivotal member 60 is held at the forwardly inclined pushed position by the front end surface 10*a* of the receptacle 11 acting through the spacer 50 which is at its pushed position. Accordingly, biasing forces accumulated in the compression coil springs 80 are released and move the slider 70 forward. The holding arms 73 receive these forces and are guided by the disengagement guiding surfaces 74*a* to undergo a resilient deformation. Thus, the hooks 74 disengage from the holding projections 40. As a result, the biasing forces of the compression coil springs 80 move the slider 70 forward from the deformation permitting to the deformation preventing position.

Figure 12A:
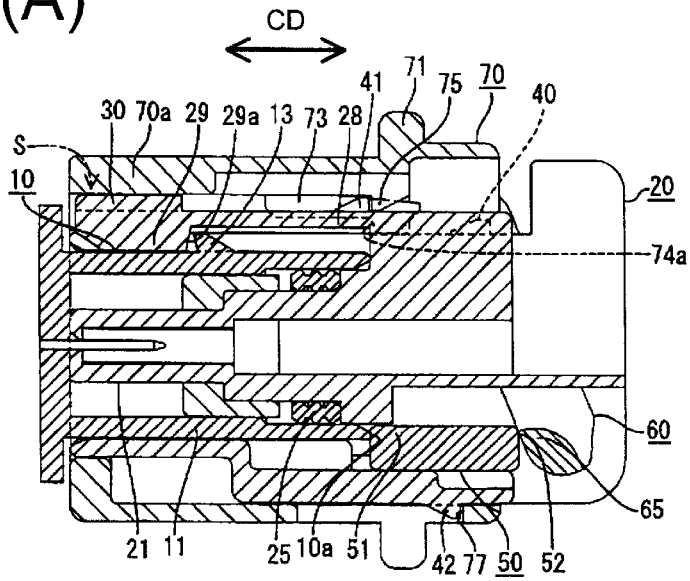
FIGS. 12(A) and 12(B) are sections similar to FIGS. 9(A) and 9(B) showing a state where the slider is at a deformation preventing position.
Figure 12B:
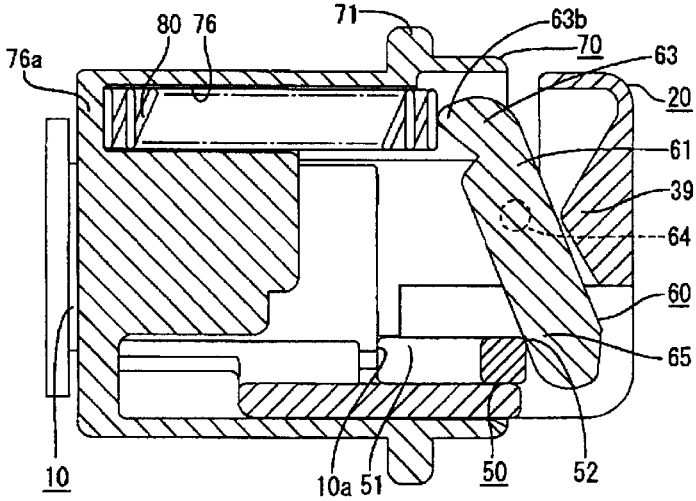

The deformation preventing portion 70*a* enters the deformation space S when the slider 70 reaches the deformation preventing position. Thus, the deformation preventing portion 70*a* faces the locking projection 30 from above and is held substantially in contact with the locking projection 30, as shown in FIG. 12. Accordingly, the lock arm 28 is prevented from being deformed away from the lock 13 and the housings 10, 20 are held firmly and properly connected. In this state, the compression coil springs 80 are held with their front and rear ends in contact with the receiving portions 76*a* and the leading ends 63*b* of the spring contacts 63 of the pivotal member 60 located at its pushed position. The stoppers 75 contact the corresponding first front-stop projections 41 and the rear edge of the escaping hole 77 contacts the second front-stop projection 42 to prevent the slider 70 from moving forward from the deformation preventing position. In the properly connected state, the seal ring 25 contacts the inner peripheral surface of the receptacle 11 and the outer peripheral surface of the terminal accommodating portion 21 to provide watertightness between the two housings 10 and 20.

Figure 13A:
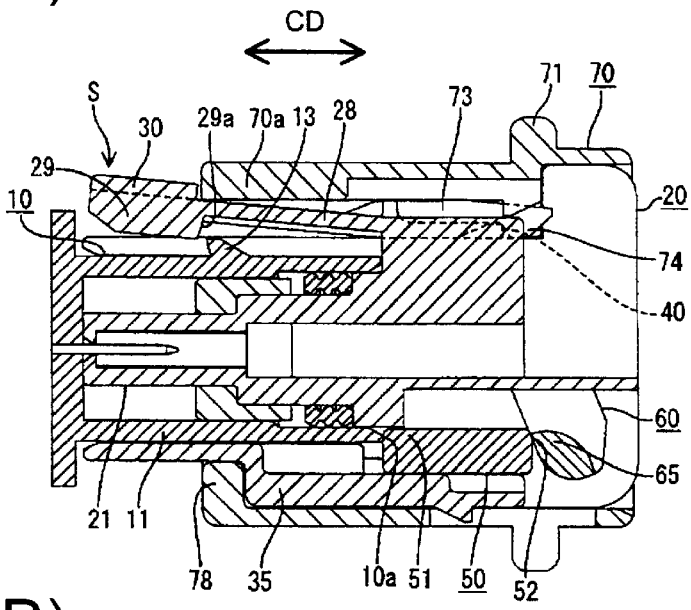
FIG. 13(A) is a section similar to FIG. 9(A) showing a state where a lock arm is deformed resiliently during a separating operation of the two housings.
Figure 13B:
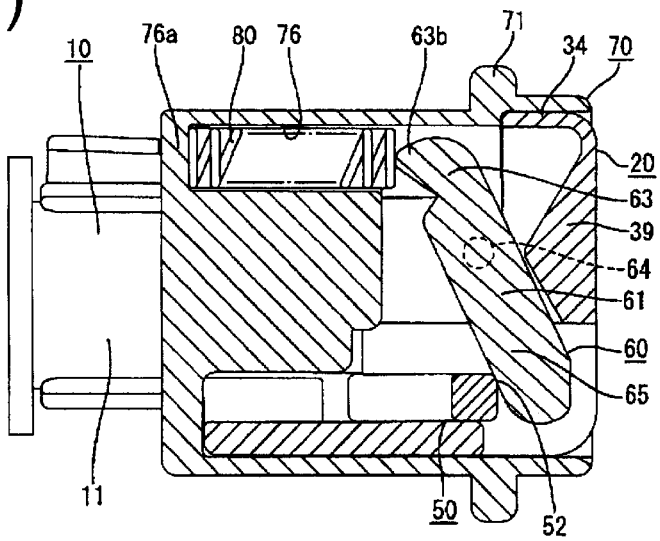
FIG. 13(B) is a section similar to FIG. 9(B) showing a state where the slider is at a deformation permitting position and the springs are compressed.
Figure 14A:
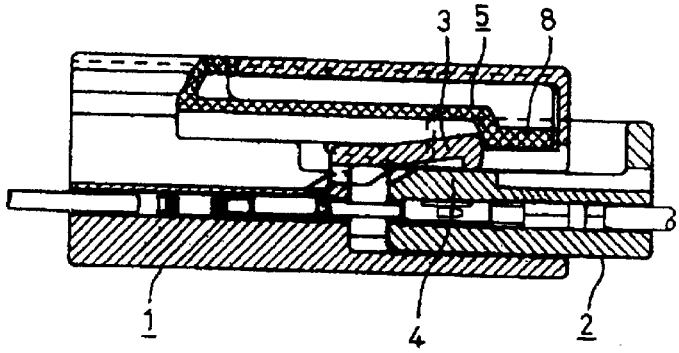
FIGS. 14(A) and 14(B) are a section along a lock arm and a section along a spring showing a partly connected state of a prior art connector.
Figure 14B:
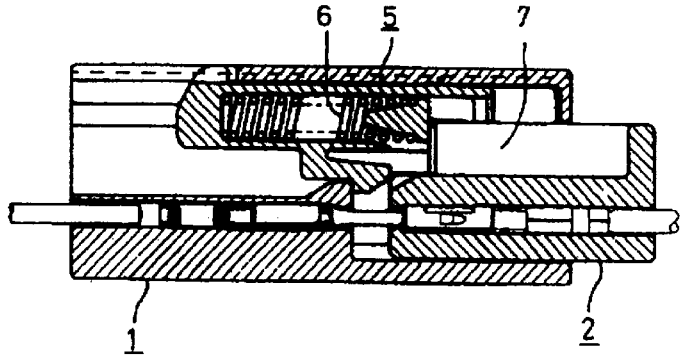
Figure 15A:
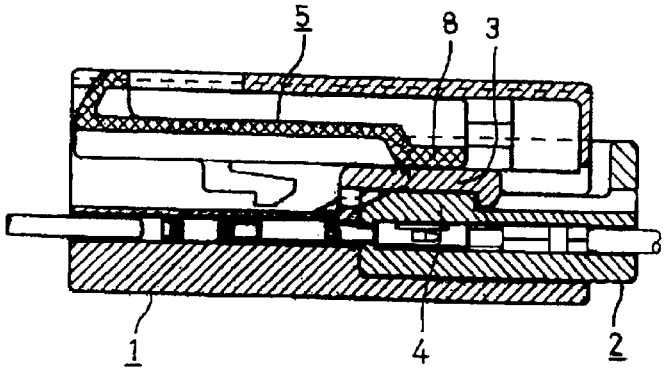
FIGS. 15(A) and 15(B) are a section along the lock arm and a section along the spring showing a properly connected state of the prior art connector.
Figure 15B:
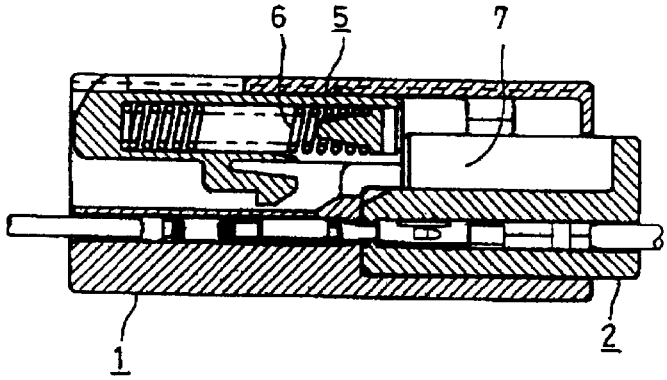

The two housings 10, 20 may be separated for maintenance or other reason. In such a case, the operable portion 71 of the slider 70 is gripped and pulled back from the deformation preventing position while compressing the compression coil springs 80. The rear-stop wall 78 engages the bottom wall 35 when the slider 70 reaches the deformation permitting position. An operation force of a specified intensity or higher is exerted on the slider 70 and acts to move the female housing 20 back from the male housing 10. The lock arm 28 and the lock projection 13 have the above-described semi-locking construction. As a result, the lock arm 28 is guided by the unlocking guide surface 29*a* of the hook 29 and deforms to disengage the hook 29 from the lock 13, as shown in FIG. 13. Thus, the female housing 20 is moved back and separated from the male housing 10. In this way, an operation of moving the slider 70 back to the deformation permitting position, an operation of resiliently deforming the lock arm 28 and an operation of separating the two housings 10, 20 can be performed at once by one operation of pulling the slider 70.

As described above, the compression coil springs 80 are pushed forward by the pivotal member 60 and are compressed resiliently during the connecting process. Thus, the slider 70 can be moved forward by the biasing forces of the compression coil springs 80 that are released when the housings 10, 20 are connected properly. Therefore, separation operability is good since the slider 70 is operated in the same direction as the female housing 20 is moved during separation. Further, the ability to move the slider 70 forward is controlled using the lock arm 28 whose movement is linked with the connecting operation. Thus, the slider 70 can be operated at a proper timing, thereby improving the operation reliability of a partial connection preventing function. Furthermore, the pushable portion 65 of the pivotal member 60 is pushed by the front end surface 10*a* of the receptacle 11 of the male housing 10 via the spacer 50. Thus, the construction of the male housing 10 can be simplified.

The lock arm 28 and the lock 13 have a semi-locking construction. As a result, the lock arm 28 is deformed and guided out of engagement with the lock 13 by the unlocking guide surface 29*a* of the hook 29 as the slider 70 is moved back from the deformation preventing position to the deformation permitting position during separation of the housings 10, 20. Therefore, separation is more efficient than a case where the operation of deforming the lock arm must be performed separately.

Further, the pivotal member 60 is supported by the supporting portions 39 at the initial position where the spring contacts 63 are held in contact with the rear ends of the compression coil springs 80. Thus, the compression coil springs 80 can be pushed securely and compressed resiliently by the spring contacts 63 of the pivotal member 60 upon connecting the two housings 10, 20.

The slider 70 can be held at the deformation permitting position by the engagement of the holding arms 73 with the holding projections 40. Thus, the connecting operation can be performed with the slider 70 at the deformation permitting position to provide good operational efficiency. Further, the semi-locking construction provides the disengagement guiding surfaces 74*a* on the hooks 74 of the holding arms 73 engageable with the holding projections 40. Thus, the holding arms 73 can be disengaged automatically from the holding projections 40 taking advantage of the biasing forces of the compression coil springs 80 and operability is better as compared to a case where the operation of resiliently deforming the lock arm needs to be performed separately.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The shafts on the outer sides of the arms are fit into the shaft holes in the outer walls to support the pivotal member in the foregoing embodiment. However, the pivotal member may be supported by fitting shafts on the rear ends of the arms into recesses formed in the supports from the front. With such an arrangement, the pivotal member can be mounted more easily into the female housing.

The pivotal member has the shafts and the female housing has the shaft holes in the foregoing embodiment. Conversely, the pivotal member may be provided with the shaft holes and the female housing may be provided with the shafts. Further, the shafts and the shaft holes may have a semicircular, rectangular or like cross section. An arrangement in which the shaft holes have an oblong cross section and the shafts slide in the shaft holes as the pivotal member is pivoted also is embraced by the present invention.

The connector includes the spacer in the foregoing embodiment. However, the spacer may be omitted and the pushable portion of the pivotal member may be pushed directly by the receptacle of the male housing.

The unlocking guide surface is on the lock arm in the foregoing embodiment, but may be on the lock or on both the lock arm and the lock.

The disengagement guiding surfaces are provided on the holding arms in the foregoing embodiment. However, they may be provided on the holding projections or on both the holding arms and holding projections Although the slider, the compression coil springs, the pivotal member and the like are assembled with the female housing in the foregoing embodiment, they may be assembled with the male housing according to the invention.

Compression coil springs are shown as the biasing members in the foregoing embodiment. However, leaf springs, resilient rods or the like may, be used instead or additionally as biasing members.

Although the connector has a watertight seal ring in the foregoing embodiment, the invention is also applicable to non-watertight connectors.

What is claimed is:

1. A connector comprising a housing connectable with a mating housing of a mating connector, wherein the housing comprises:

a lock arm disposed for moving onto a lock of the mating housing and resiliently deforming during connection of the housings and returning to engage the lock when the housings are connected, a slider movable substantially along a connecting direction of the housings between a deformation preventing position where the slider prevents deformation of the lock arm and a deformation permitting position where the slider permits the deformation of the lock arm, the slider engaging the resiliently deformed lock arm during connection the housings and being prevented from moving from the deformation permitting position, a pivotal member supported for pivoting about an axis aligned at an angle to the connecting direction, the pivotal member having first and second ends, the first end being pushed by the mating housing during connection the housings, and at least one biasing member between the slider and the second end of the pivotal member and being resiliently deformed while accumulating a biasing force to separate the housings as the slider and the second end of the pivotal member are displaced toward each other.

2. The connector of claim 1, wherein the slider, at the deformation preventing position, is in a deformation space for the lock arm to prevent deformation of the lock arm and at the deformation permitting position the slider is retracted from the deformation space to permit deformation of the lock arm.

3. The connector of claim 1, wherein at least one of the lock arm and the lock have an unlocking guide surface for guiding the disengagement of the lock arm from the lock by resiliently deforming the lock arm when a force of at least a specified intensity acts to move the housing backward.

4. The connector of claim 1, wherein the housing has a support for supporting the pivotal member in contact with the biasing member before the housings are connected.

5. The connector of claim 1, wherein the slider comprises at least one holding arm for preventing the slider from moving forward from the deformation permitting position by being resiliently engaged with at least one holding portion on the housing.

6. The connector of claim 5, wherein at least one of the holding arm and the holding portion has a disengagement guiding surface for guiding the disengagement of the holding arm from the holding portion by resiliently deforming the holding arm when a force of at least a specified intensity acts to move the slider forward.

7. The connector of claim 1, wherein a movable member is on the housing, and wherein the pivotal member is pushed by the pushing portion of the mating housing via the movable member.

8. The connector of claim 7, wherein before the housings are connected, the pivotal member is at an initial position, where a spring contact of the pivotal member is held substantially in contact with the biasing member, and where at least one portion of the pivotal member is held in contact with at least one corresponding supports of the housing, whereby the pivotal member is supported at the initial position while being inclined.

9. The connector of claim 8, wherein, when the pivotal member is at the initial position, a pushable portion of the pivotal member is held substantially in contact with the moving member.

10. A connector assembly comprising the connector of claim 1 and a mating connector connectable therewith.

11. A connector, comprising:

a housing having opposite front and rear ends and defining a connecting direction extending between the ends;

a slider mounted on the housing and movable substantially along the connecting direction;

a pivotal member supported on the housing for pivoting about an axis normal to the connecting direction, the pivotal member having first and second ends, the first end being pushed by a mating connector during connection the connectors, the second end being between the slider and the rear end of the housing; and at least one biasing member between the slider and the second end of the pivotal member for biasing the slider forwardly.

12. The connector of claim 11, the housing has a resiliently deformable lock arm disposed for locked engagement with a mating housing, the slider being movable between a deformation preventing position where the slider prevents deformation of the lock arm and a deformation permitting position where the slider permits the deformation of the lock arm.

13. The connector of claim 12, wherein the slider is configured for engaging the resiliently deformed lock arm for preventing the slider from moving to the deformation preventing position.

14. The connector of claim 13, further comprising a movable member on the housing, and movable rearwardly into engagement with the first end of the pivotal member for pivoting the pivotal member.

15. The connector of claim 13, wherein at least one of the lock arm and a lock of the mating housing have an unlocking guide surface for guiding the disengagement of the lock arm from the lock by resiliently deforming the lock arm when a force of at least a specified intensity acts to move the housing backward.

16. The connector of claim 13, wherein the slider comprises at least one holding arm for preventing the slider from moving forward from the deformation permitting position by being engaged with at least one holding portion on the housing.

17. The connector of claim 16, wherein at least one of the holding arm and the holding portion has a disengagement guiding surface for guiding the disengagement of the holding arm from the holding portion by resiliently deforming the holding arm when a force of at least a specified intensity acts to move the slider forward.

18. A connector, comprising:

a housing having opposite front and rear ends, a fitting space extending into the front end for receiving a mating housing along a connecting direction, the housing having a resiliently deformable lock arm disposed for locked engagement with the mating housing;

a slider mounted on the housing and movable substantially along the connecting direction between a deformation preventing position where the slider prevents deformation of the lock arm and a deformation permitting position where the slider permits the deformation of the lock arm;

a pivotal member supported on the housing for pivoting about an axis normal to the connecting direction, the pivotal member having a first end disposed for receiving a rearward force as the mating connector is received in the fitting space, the pivotal member further having second end being rearward of at least a portion of the slider; and at least one biasing member between the slider and the second end of the pivotal member for biasing the slider forwardly and biasing the second end of the pivotal member rearwardly.

19. The connector of claim 18, wherein the slider is configured for engaging the resiliently deformed lock arm for preventing the slider from moving to the deformation preventing position.

20. The connector of claim 18, wherein at least one of the lock arm and a lock of the mating housing have an unlocking guide surface for guiding the disengagement of the lock arm from the lock by resiliently deforming the lock arm when a force of at least a specified intensity acts to move the housing backward.

* * * * *